US009068498B2

(12) United States Patent
Callahan

(10) Patent No.: US 9,068,498 B2
(45) Date of Patent: Jun. 30, 2015

(54) REDUCTION OF RING CLIPPING IN TWO-STROKE CYCLE ENGINES

(71) Applicant: Achates Power, Inc., San Diego, CA (US)

(72) Inventor: Brian J. Callahan, San Diego, CA (US)

(73) Assignee: ACHATES POWER, INC., San Diego, CA (US)

( * ) Notice: Subject to any disclaimer, the term of this patent is extended or adjusted under 35 U.S.C. 154(b) by 42 days.

(21) Appl. No.: 13/757,220

(22) Filed: Feb. 1, 2013

(65) Prior Publication Data

US 2014/0216425 A1 Aug. 7, 2014

(51) Int. Cl.

| | |
|---|---|
| ***F02B 25/00*** | (2006.01) |
| ***F02B 25/08*** | (2006.01) |
| ***F02F 1/18*** | (2006.01) |
| ***F02F 1/22*** | (2006.01) |
| *F02B 33/04* | (2006.01) |
| *F02B 61/04* | (2006.01) |
| *F02B 25/14* | (2006.01) |
| *F02B 23/06* | (2006.01) |
| *F02B 75/02* | (2006.01) |

(52) U.S. Cl.

CPC ..... *F02B 25/08* (2013.01); *F02B 33/04* (2013.01); *F02B 61/045* (2013.01); *F02B 25/14* (2013.01); *F02B 23/0663* (2013.01); *F02B 2075/025* (2013.01); *F02F 1/186* (2013.01); *F02F 1/22* (2013.01)

(58) Field of Classification Search

CPC .... F02B 2075/025; F02B 25/14; F02B 33/04; F02B 61/045; F02F 1/22

USPC ..... 123/65 P

See application file for complete search history.

(56) References Cited

U.S. PATENT DOCUMENTS

| | | | | |
|---|---|---|---|---|
| 4,337,734 | A | 7/1982 | Iio | 123/65 |
| 4,458,636 | A * | 7/1984 | Kania | 123/73 R |
| 4,643,140 | A | 2/1987 | Whipple | 123/65 PE |
| H701 | H | 11/1989 | Ancheta | 123/65 |
| 5,086,734 | A | 2/1992 | Nakai | 123/65 P |
| 6,293,234 | B1 | 9/2001 | David | |
| 2006/0157003 | A1 * | 7/2006 | Lemke et al. | 123/41.38 |
| 2007/0245892 | A1 * | 10/2007 | Lemke et al. | 92/169.1 |

OTHER PUBLICATIONS

Gustavson, E, "Port Filing", *CYCLE*, May 1976, pp. 35-37.
Anonymous, "Top End Rebuild", *CYCLE*, Dec. 1976, pp. 93-99.

* cited by examiner

*Primary Examiner* — Lindsay Low
*Assistant Examiner* — Charles Brauch
(74) *Attorney, Agent, or Firm* — Terrance A. Meador

(57) ABSTRACT

A port for a cylinder of a two-stroke cycle engine includes at least one generally circumferential array of port openings. Port openings have a shape that reduces ring clipping during engine operation. The port opening shape is defined at a bore surface by opposing top and bottom edges joined by side edges. Each of the top and bottom edges is characterized by rounded corner transitions to the side edges, a rounded peak, and inclined ramp portions extending from the rounded corner transitions to the rounded peak.

15 Claims, 4 Drawing Sheets

REDUCTION OF RING CLIPPING IN TWO-STROKE CYCLE ENGINES

RELATED APPLICATIONS

This application contains subject matter related to that of U.S. Ser. No. 12/931,199; filed Jan. 26, 2011 for "Oil Retention in the Bore/Piston Interfaces of Ported Cylinders in Opposed-Piston Engines", published as US 2012/0186561 on Jul. 26, 2012 and U.S. Ser. No. 13/385,127, filed Feb. 2, 2012 for "Opposed-Piston Cylinder Bore Constructions with Solid Lubrication in the Top Ring Reversal Zones", published as US 2013/0199503 on Aug. 8, 2013.

BACKGROUND

The field relates to port constructions for two-stroke cycle engines in which cylinder port openings have edges shaped to reduce clipping of piston rings as the pistons move across the ports during engine operation.

A two-stroke cycle engine is an internal combustion engine that completes a power cycle with a single complete rotation of a crankshaft and two strokes of a piston connected to the crankshaft. One example of a two-stroke cycle engine is an opposed-piston engine in which a pair of pistons is disposed in opposition in the bore of a cylinder. The pistons are disposed crown-to-crown in the bore for reciprocating movement in opposing directions. The cylinder has inlet and exhaust ports that are spaced longitudinally so as to be disposed near respective ends of the cylinder. The opposed pistons control the ports, opening the ports as they move to their bottom center (BC) locations, and closing the ports as they move toward their top center (TC) locations. One of the ports provides passage of the products of combustion out of the bore, the other serves to admit charge air into the bore; these are respectively termed the "exhaust" and "intake" ports.

Each port includes one or more arrays of circumferentially-spaced openings through the sidewall of the cylinder. In some descriptions the openings themselves are called ports. However, in this description, a "port" refers to a circular area near an end of a cylinder in which a collection of port openings is formed to permit the passage of gas into or out of the cylinder. The port openings are separated by bridges (sometimes called "bars") that support transit of the piston rings across the ports.

The pistons are equipped with one or more rings mounted to their crowns. The skirt, lands, and rings of each piston create a seal that prevents gas flow into or out of the port that the piston controls. Any tangential tension of a ring in its constrained state in the bore causes a radial force outward. Thermal deformation due to combustion heat adds to this force. This radial force causes the ring to deflect in an outward radial direction of the bore into the port openings as the ring traverses the port. When the ring must travel in an inward radial direction of the bore back into the bore, which happens as the port closes and also as it opens fully, the ring must be guided radially inward of the bore.

If the geometry of a port edge at the bore surface is not well designed, the distance over which the ring is allowed to move radially inwardly of the bore can be too short, which increases the inward acceleration of the ring, and hence raises the contact force and stress. This adverse motion is called "ring clipping" (or "port clipping" or "port sticking"). Ring clipping causes an overloaded condition in which the lubricant film acting between the bore and an outer ring surface which contacts the bore is pierced and asperities of the ring and bore surfaces begin to contact. This causes undue wear and increases friction, which leads to localized heating and high temperatures. These high temperatures weaken the metals of which the ring and cylinder are constituted. Combined with the high contact stress, this leads to plastic deformation of both the ring and the port opening edges, which disrupts the geometry and roughens the surface texture, exposing more asperities. If the metals are active enough, then fusion can occur. Combined with plastic deformation, this fusion becomes scuffing, evidenced by torn, smeared, folded, and piled ring and/or cylinder material. Maximum contact stress is reduced by limiting the acceleration of the ring into and out of the port openings. Acceleration is reduced by spreading out the radial motion of the ring over time.

FIGS. 1A through 1D illustrate prior art port opening shapes in the bore surface. In each figure, the view is from the interior of a cylinder in a radial direction of the cylinder toward the bore surface. The simplest prior art port opening shape is seen in FIG. 1A, in which a port opening shape 12 includes top and bottom edges 13 and 14 joined by side edges 15. In this regard, the top edge 13 is the edge nearest the TC location of the controlling piston and the bottom edge 14 is the edge nearest the BC location of the controlling piston. The top and bottom edges 13 and 14 are oriented substantially normally to the cylinder axis 16. The side edges 15 are oriented generally longitudinally with respect to the axis. Together, the edges 13, 14, and 15 define a quadrilateral shape. For a given port width W, this provides the highest integral of open area and crankshaft rotation angle ("angle·area product") which, in turn, yields the maximum open time-area product for any given crankshaft speed. Because the capacity of a port opening to conduct gas flow is directly proportional to its time·area product, this maximizes engine efficiency or power. However, the flat top and bottom edges 13 and 14 cause a ring to move instantly outward into the port opening (and then instantly inward into the bore), resulting in ring clipping at both edges.

Adding corner rounds 18 to the quadrilateral shape as per FIG. 1B yields only a slight improvement over the shape of FIG. 1A. Excursion into the port opening is still substantial as the ring approaches the flat top and bottom edges, producing clipping almost as severe as the straight quadrilateral shape of FIG. 1A.

Other prior art port opening shapes are provided with elliptical or arched top and bottom edges 13, 14 as per FIG. 1C. These may be described by an ellipse or by three circular arcs with a major arc in the middle of the edge connected to two minor arcs in the corners. Either can be fully described with a major and a minor radius. However, an elliptical top or bottom edge with its major radius controlling the ring motion does not spread out the ring motion over a particularly long distance over the entire elliptical shape. Over most of the ellipse the motion of the ring is spread out, but at the last portion, as the elliptical form approaches its major radius, ring acceleration is quite high, thus causing undue wear.

Another port opening shape shown in FIG. 1D goes to the extreme of providing each of the top and bottom edges 13, 14 with a semi-circular shape having a radius equal to half the port width. The semi-circularity does provide smoother ring transitions, which reduces wear but which also reduces the area of the port opening, thereby limiting the angle·area product.

Accordingly, it is desirable to equip an opposed-piston engine for smoother transitions of piston rings across port openings than are presently achievable with prior art port edge constructions. It is desirable to further reduce wear and scuffing caused by ring clipping while at the same time maintaining an angle·area product approaching that of the quadrilateral shape. By reducing the maximum contact stress caused by the surface of the ring pushing against the edge of the port, asperity contact will be reduced, thereby avoiding scuffing and wear and enhancing the durability of the engine. At the same time, the port opening shape should provide an angle·area product approaching that of the quadrilateral shape.

SUMMARY

It is an object to spread out the distance over which a piston ring transitions from jutting into the port opening to being radially supported by the bore surface. A desirable edge construction reduces ring clipping, without producing sudden transitions of the ring into and out of the port opening and without sacrificing angle·area product.

Such an edge construction exploits the smooth transition provided by the semi-circular shape but uses a radius even smaller than half the port width, which leads to reducing the peak acceleration and in turn the peak contact stress. This provides better resistance to wear than even the fully semi-circular transition edges but with essentially the same angle·area product as the ellipsoidal transition port edge construction. Also, the shape disclosed herein can provide a higher angle·area product than a semi-circular construction.

Accordingly, a further object is to provide an improved shape for port openings that will reduce ring clipping without sacrificing angle·area product.

Another object is to provide improved shapes for the exhaust and/or intake ports of an opposed-piston engine.

DETAILED DESCRIPTION OF THE PREFERRED EMBODIMENTS

Figure 2:
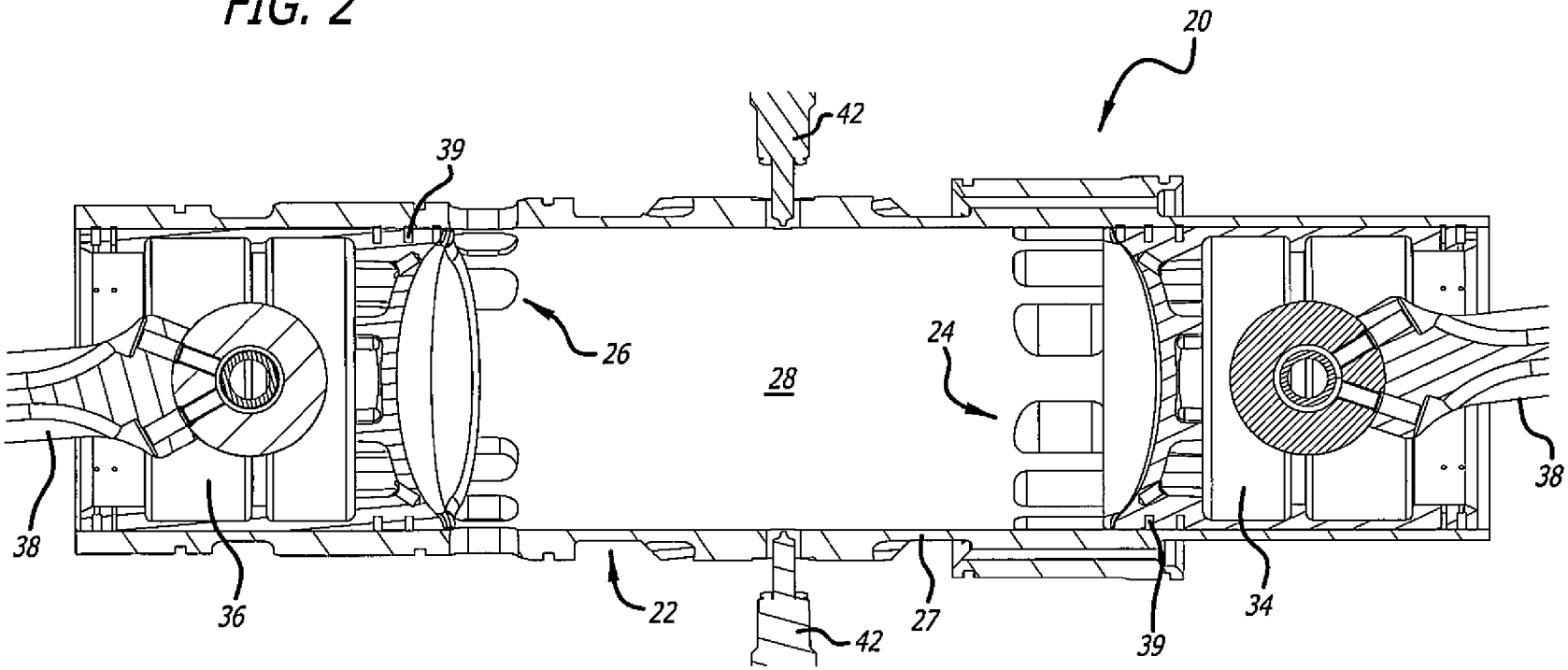
FIG. 2 is a longitudinal cross-sectional view taken through a cylinder of an opposed-piston engine constructed for two stroke-cycle operation.

As per FIG. 2, an opposed-piston engine constructed for two stroke-cycle operation is generally indicated by reference numeral 20. The engine 20 includes a cylinder 22 with longitudinally-spaced exhaust and intake ports 24 and 26 formed in the cylinder sidewall near respective ends of the cylinder. At least one of these ports is configured to reduce ring clipping by reducing sudden transitions of a piston ring into and out of the port openings.

The opposed-piston engine includes at least the one cylinder 22, and may include two, three, or more cylinders. The cylinder 22 may be constituted of a cylinder liner or sleeve supported in a block, a frame, a spar, or any other equivalent structure. The, cylinder has a sidewall 27 defining a cylindrical bore having a surface 28. The openings of the ports 24 and 26 are formed near respective ends of the sidewall and open through the bore surface 28. A pair of pistons 34 and 36 is disposed for opposed sliding movement on the bore surface 28. Each of the pistons is coupled by a connecting rod 38 to a respective one of two crankshafts (not seen) that are mounted outside of respective ends of the cylinder. See commonly-owned US 2012/0285422 for a more complete description of the general architecture of the engine 20. Each of the pistons 34 and 36 is equipped with one or more rings 39 that are mounted in annular grooves in the crowns of the pistons.

The pistons 34 and 36 are shown at respective positions slightly after scavenging has commenced. In this regard, the piston 36 is slightly away from its BC location, and so the intake port 26 is just starting to close from its fully open position for transport of charge air into the cylinder. The piston 34 is farther away from its BC location because it leads the intake piston 36 and so the exhaust port 24 is also closed slightly from its fully open position for transport of exhaust gasses out of the bore. As the motion continues, the piston 34 will move from its BC location toward its TC location in the interior of the bore, closing the exhaust port 24. The piston 36 will also continue to move from BC, closing the intake port 26 as it moves toward TC. After the last port closes and the pistons continue to move closer together, charge air is compressed between their end surfaces. Fuel injected through the sidewall of the cylinder via injectors 42 mixes with the pressurized charge air, ignites, and drives pistons 34 and 36 from TC to BC in an expansion stroke.

Manifestly, it is a desirable objective to reduce ring clipping in order to increase efficiency of the engine and enhance durability of the piston rings. However, a piston ring makes four transitions over a port during each complete cycle of a two-stroke opposed-piston engine. Thus a substantial benefit is realized by equipping port openings with top and bottom edge constructions that reduce or eliminate sudden transitions of the ring into and out of the port openings. Additional benefit is realized if these top and bottom edge constructions yield a good angle·area product.

Figure 1A:
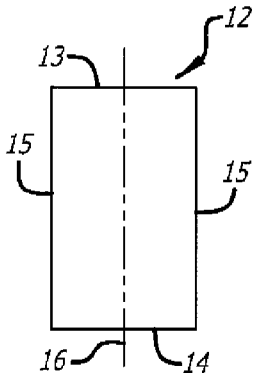
FIG. 1A (Prior Art)
FIGS. 1A through 1D illustrate prior art port opening shapes. In each figure, the view is from the interior of a cylinder in a radial direction of the cylinder toward the bore surface.
Figure 1B:
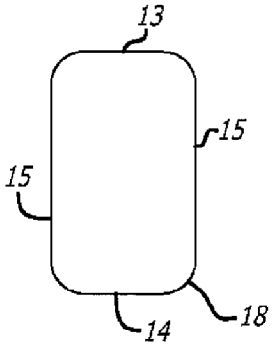
FIG. 1B (Prior Art)
Figure 1C:
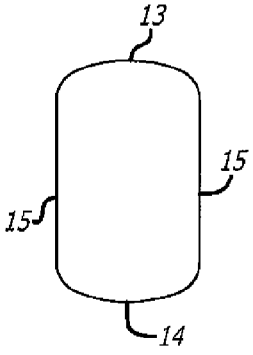
FIG. 1C (Prior Art)
Figure 1D:
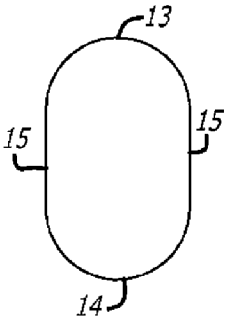
FIG. 1D (Prior Art)
Figure 3A:
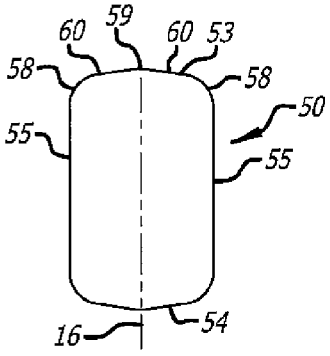
FIG. 3A is a side elevation view of a port opening shape in which top and bottom edges are shaped to reduce ring clipping by limiting sudden transitions of the ring into and out of the port opening.

Referring now to FIG. 3A, a preferred construction for at least the exhaust port 24 includes port openings that meet the objectives and provide the benefits set forth herein. In this regard, the shape 50 of a port opening in the bore surface includes a top edge 53 and a bottom edge 54 joined by side edges 55. The top and bottom edges 53 and 54 are oriented generally transversely to the cylinder longitudinal axis 16 and are similarly constructed. Each of the edges 53 and 54 includes rounded corners, angled ramps, and a rounded peak. With reference, for example, to the top edge 53, rounded corners 58 join the top edge 53 to the side edges 55. A rounded peak 59 is disposed between the rounded corners 58 and is offset outwardly of the opening 50, in the TC direction of the controlling piston (not shown). Inclined ramp portions 60 extend from the rounded corners 58 to the rounded peak 59. Although the edges 53, 54, and 55 are shown in a generally rectangular shape, this is not essential, other generally quadrilateral shapes can be used, although it is preferred that the top and bottom edges 53 and 54 be oriented generally perpendicularly to the direction of piston movement in such shapes.

Figure 3B:
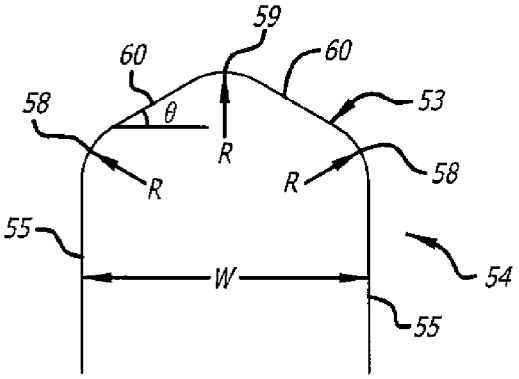
FIG. 3B is a magnified view of a portion of the port opening shape of FIG. 3A, with dimensions exaggerated in order to more clearly illustrate certain features of a port opening top edge.

FIG. 3B is a magnified view of the top edge portion of the port opening shape 50 of FIG. 3A, with dimensions exaggerated in order to more clearly illustrate certain features of the shape. In the top edge, a radius R of the rounded corners 58 can be set to a minimum value dictated by manufacturing considerations, typically the radius of the intersection between a cutting tool and the bore surface; the radius of the rounded peak 59 can also be set to this minimum. Preferably, the radius R is substantially less than half of a width W measured with respect to the side edges 55. An angle θ can be set for the inclination of the ramp portions 60 so as to limit acceleration of the ring in a radial direction of the cylinder to be equal to a maximum value chosen according to desired wear limits. This maximizes the port angle·area product. For example, the value of the angle θ can be in the range $6° < \theta < 10°$.

Figure 4:
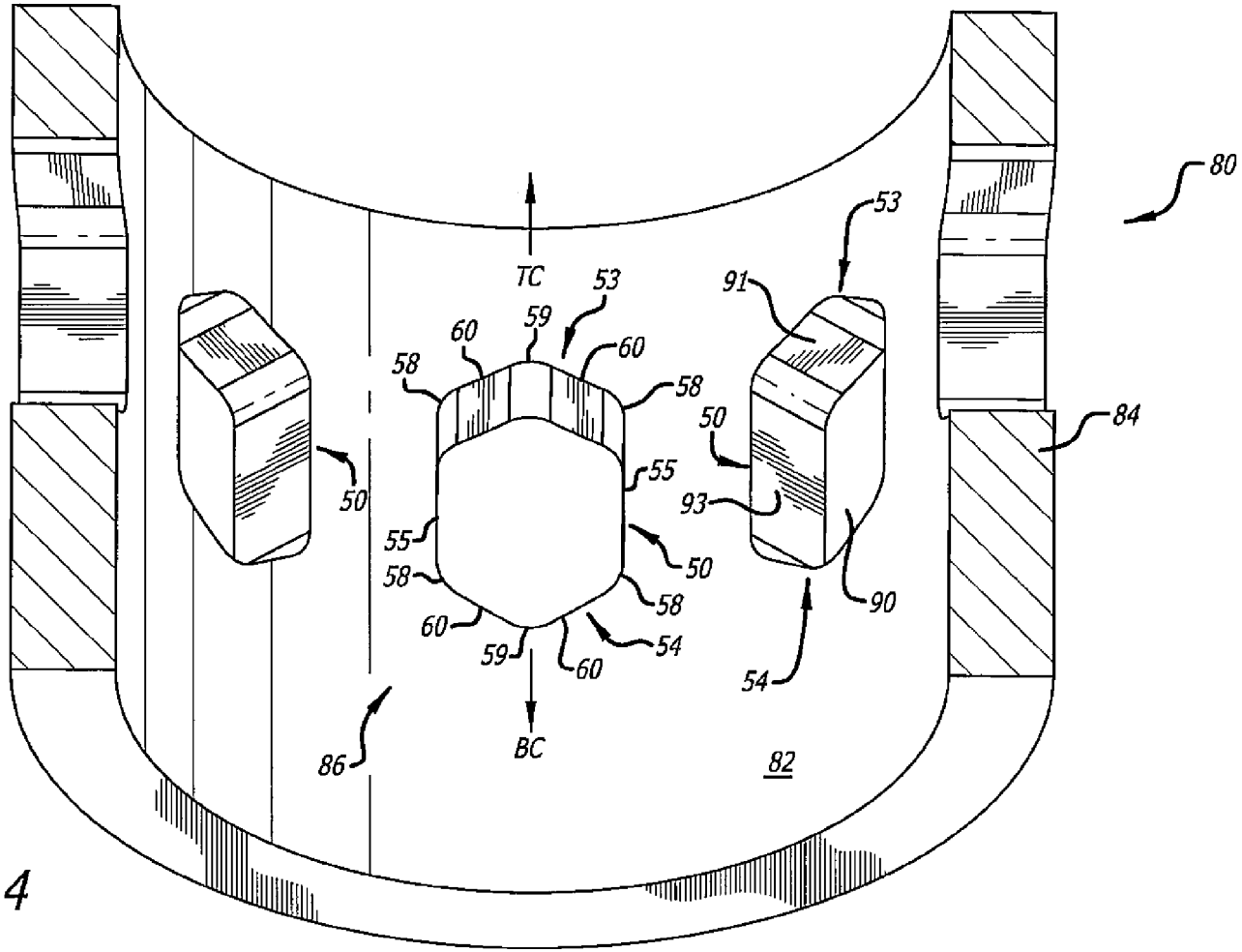
FIG. 4 is a side sectional view of one end of a cylinder for an opposed-piston engine having a port configured with port opening shapes according to FIG. 3.

In FIG. 4, reference numeral 80 indicates a ported cylinder for an opposed-piston engine constructed for two stroke-cycle operation. The arrows TC and BC indicate the directions toward the top and bottom center locations of the controlling piston The cylinder 80 includes a bore surface 82 and a sidewall 84. The cylinder 80 also includes spaced-apart exhaust and intake ports, although only the exhaust port 86 is shown. Each port includes at least one generally circumferential array of port openings, and each port opening extends from the bore surface 82 through the sidewall 84. For example, the exhaust port 86 includes an array of port openings in which a port opening shape 50 in the bore surface 82 is defined by opposing top and bottom edges 53 and 54 joined by side edges 55. Each of the top and bottom edges 53 and 54 is characterized by rounded corner transitions 58 to the side edges 55, a rounded peak 59, and inclined ramp portions 60 extending from the rounded corner transitions to the rounded peak.

With reference to FIG. 4, because the cylinder sidewall 84 has a thickness, each port opening shape 50 frames a passage 90 that penetrates the sidewall 84 and opens through the outer surface (not shown) of the sidewall. It is not necessary that the outer surface opening have the same shape as the port opening shape 50 in the bore surface 82. In fact, the opening through the outer sidewall surface generally has a different shape than the bore surface. The reason is that the thickness of the sidewall is used to form a passage shape designed to partially guide the gas flow for good in-cylinder flow structure and to minimize flow restriction through the intake and exhaust ducting. A specific flow structure of the passage 90 is useful both for scavenging and/or combustion optimization. Consequently, the resulting port opening shape through the outer sidewall surface is a complex combination of all these requirements.

In a preferred design, which is not intended to limit the scope of these teachings, the horizontal passage surfaces 91 of the passage 90 bordered by the top and bottom edges 53 and 54 are kept flat as the passage goes from the bore 82 to outside surface of the cylinder sidewall for machining reasons. The vertical surfaces 93 of the passage are angled for the engine performance reasons stated above. Even though this means every other face will incline toward the center of a window, only 4-axis control is needed for machining. It is not necessary to provide significant chamfer (or bevel) on the edges 53, 54, and 55 of the port opening shape 50 in this design. This provides a benefit by reducing cost and improving manufacturing feasibility. On the other hand, a chamfer or round on edge 53 would generally help exhaust flow during the initial port opening of the exhaust port due to reduced restriction of the gas jet.

Figure 5:
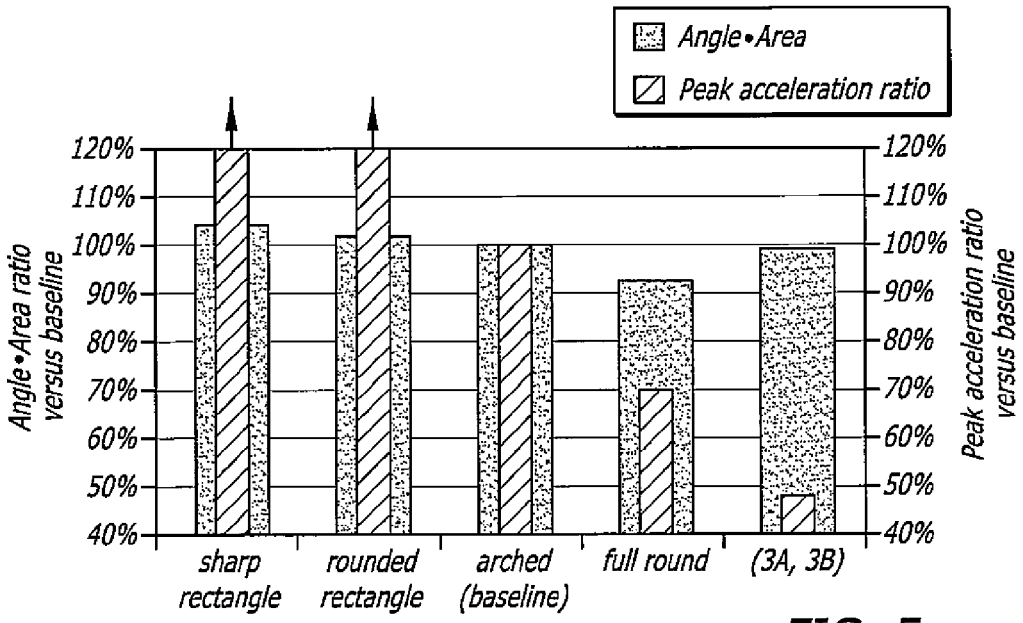
FIG. 5 is a graph comparing angle·area product and peak acceleration for the same expansion stroke for the prior art port opening shapes of FIGS. 1A-1D and the port opening shape of FIGS. 3A and 3B.
Figure 6:
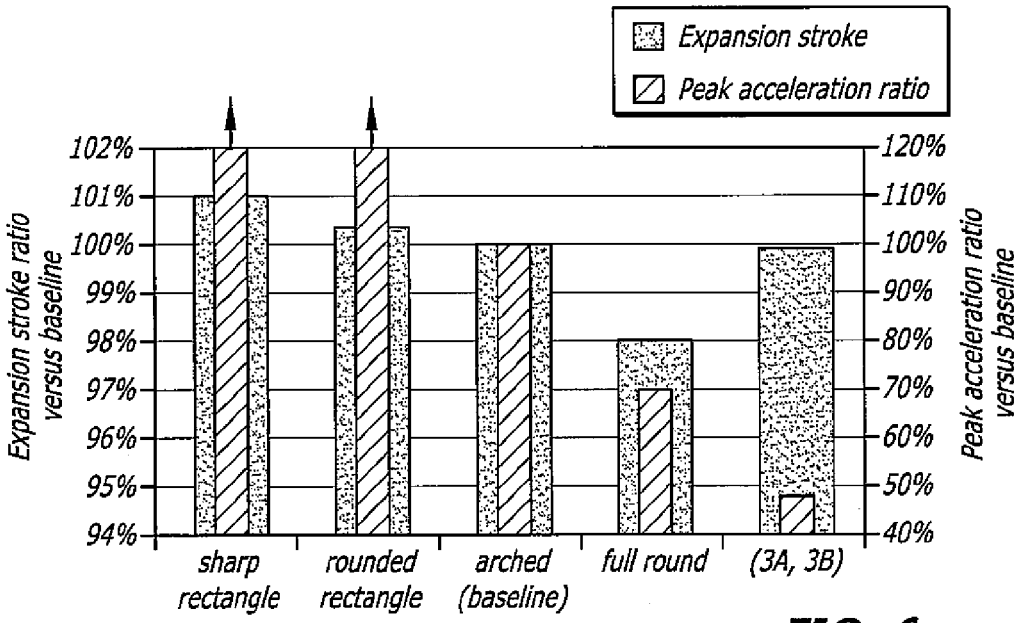
FIG. 6 is a graph comparing expansion stroke and peak acceleration for same expansion stroke for the prior art port opening shapes of FIGS. 1A-1D and the port opening shape of FIGS. 3A and 3B.

FIGS. 5 and 6 compare the prior art port opening shapes of FIGS. 1A-1D and the port opening shape of FIGS. 3A and 3B with respect to angle·area products matched by adjusting port opening height. Because an increased expansion stroke improves the thermodynamic efficiency of the engine, the port opening shape with the shortest height for a given angle·area will deliver the best fuel economy. As can be seen, the fully round shape of FIG. 1D yields the worst performance. The sharp and rounded rectangular shapes of FIGS. 1A and 1B yield the best fuel economy, but also cause the worst ring clipping. The port opening shape of FIGS. 3A and 3B delivers a desirable combination of good fuel efficiency and minimal ring clipping.

Although a port opening shape has been described with reference to preferred embodiments, it should be understood that various modifications can be made without departing from the spirit of the underlying principles, which are embodied in the following claims.

The invention claimed is:

1. A port for a cylinder of an internal combustion engine, the cylinder including a bore surface and a sidewall, the port including at least one generally circumferential array of port openings near an end of the cylinder, each port opening extending from the bore through the sidewall, in which the port openings have a port opening shape in the bore surface defined by opposing top and bottom edges joined by side edges, each of the top and bottom edges characterized by rounded corner transitions to the side edges, a rounded peak, and inclined ramp portions extending from the rounded corner transitions to the rounded peak, in which the rounded peak is disposed between the rounded corners and is offset outwardly of a port opening, in a top center direction of a piston controlling the port.

2. The port of claim 1, in which each of the rounded corner transitions and the rounded peak is characterized by a radius, R.

3. The port of claim 2, in which the top and bottom edges are oriented substantially transversely to a longitudinal cylinder axis.

4. The port of claim 3, in which a width is defined between the side edges and R is less than one half the width.

5. The port of claim 4, in which the internal combustion engine is an opposed-piston engine and the port is one of an intake port and an exhaust port.

6. A ported cylinder for an engine constructed for two stroke-cycle operation, in which:

the cylinder includes a bore surface, a sidewall, and spaced-apart exhaust and intake ports;

the exhaust port includes at least one generally circumferential array of port openings near an end of the cylinder, and each port opening extends from the bore through the sidewall; and, the port openings have a port opening shape in the bore surface defined by opposing top and bottom edges joined by side edges, and each of the top and bottom edges is characterized by rounded corner transitions to the side edges, a rounded peak, and inclined ramp portions extending from the rounded corner transitions to the rounded peak, in which the rounded peak is disposed between the rounded corners and is offset outwardly of a port opening, in a top center direction of a piston controlling the port.

7. The ported cylinder of claim 6, in which each of the rounded corner transitions and the rounded peak is characterized by a radius, R.

8. The ported cylinder of claim 7, in which the top and bottom edges are oriented substantially transversely to a longitudinal cylinder axis.

9. The ported cylinder of claim 8, in which a width is defined between the side edges and R is less than one half the width.

10. The ported cylinder of claim 9, in which the engine is an opposed-piston engine and the port is one of an intake port and an exhaust port.

11. An opposed piston engine; comprising:

at least one cylinder with a bore surface and longitudinally-spaced exhaust and intake ports, and a pair of opposed pistons disposed in the cylinder for sliding movement along the bore surface; and, the exhaust port including at least one generally circumferential array of port openings near an end of the cylinder, and each port opening extending from the bore through the sidewall; in which, the port openings have a port opening shape in the bore surface defined by opposing top and bottom edges joined by side edges, and each of the top and bottom edges is characterized by rounded corner transitions to the side edges, a rounded peak, and inclined ramp portions extending from the rounded corner transitions to the rounded pea, in which the rounded peak is disposed between the rounded corners and is offset outwardly of a port opening, in a top center direction of a piston controlling the port.

12. The opposed piston engine of claim 11, in which each of the rounded corner transitions and the rounded peak is characterized by a radius, R.

13. The opposed piston engine of claim 12, in which the top and bottom edges are oriented substantially transversely to a longitudinal cylinder axis.

14. The opposed piston engine of claim 13, in which a width is defined between the side edges and R is less than one half the width.

15. The opposed piston engine of claim 11, in which the intake port includes at least one generally circumferential array of port openings, each port opening extends from the bore through the sidewall, and each port opening has the port opening shape.

* * * * *

UNITED STATES PATENT AND TRADEMARK OFFICE

CERTIFICATE OF CORRECTION

PATENT NO. : 9,068,498 B2
APPLICATION NO. : 13/757220
DATED : June 30, 2015
INVENTOR(S) : Brian J. Callahan It is certified that error appears in the above-identified patent and that said Letters Patent is hereby corrected as shown below:

In the Claims

Column 8, claim 11, line 5, change “pea” to read -- peak --

Signed and Sealed this
Twelfth Day of April, 2016

Michelle K. Lee

Michelle K. Lee
*Director of the United States Patent and Trademark Office*